United States Patent [19]

Hollander et al.

[11] Patent Number: 5,014,907

[45] Date of Patent: May 14, 1991

[54] COLLAPSIBLE AND CONFORMABLE CONTAINER

[75] Inventors: Milton B. Hollander, Stamford; Louis Rivera, Branford, both of Conn.

[73] Assignee: Omega Engineering, Inc., Stamford, Conn.

[21] Appl. No.: 530,623

[22] Filed: May 31, 1990

[51] Int. Cl.[5] ..... B65D 5/42

[52] U.S. Cl. ..... 229/117.01; 229/40; 229/101

[58] Field of Search ..... 229/101, 40, 117.01; 206/424

[56] References Cited

U.S. PATENT DOCUMENTS

| | | | |
|---|---|---|---|
| 393,899 | 12/1888 | Haines | 229/117.01 |
| 3,307,768 | 3/1967 | Growney | 229/117.01 |
| 3,411,691 | 11/1968 | Whitaker et al. | 229/117.01 |
| 3,473,723 | 10/1969 | Bolling, Jr. et al. | 229/117.01 |
| 3,658,240 | 4/1972 | Stoll | 229/40 |
| 4,130,237 | 12/1978 | Struble | 229/40 |

FOREIGN PATENT DOCUMENTS

| | | | |
|---|---|---|---|
| 1395638 | 3/1965 | France | 229/40 |

*Primary Examiner*—Gary E. Elkins
*Attorney, Agent, or Firm*—Bruce E. Hosmer

[57] ABSTRACT

A collapsible box-like container of the type constructed to fold flat for storage and shipping, is provided with a reverse integral hinge portion which is positioned to lie in abutting parallel relation with a second integral hinge on the opposite side of a third integral hinge portion when the container is folded flat; the reverse hinge and the second hinge may be displaced simultaneously in nested relationship to define an exterior angle at the reverse hinge which is substantially congruent with the interior angle formed at said second hinge. This construction permits the effective width of the flattened container to be reduced for shipment by folding into a right angle shape so that it conforms to the exterior configuration of another object such as a book or a separate, rigid box, for example.

4 Claims, 1 Drawing Sheet

COLLAPSIBLE AND CONFORMABLE CONTAINER

This invention relates generally to collapsible carton containers having integral hinge portions, and more specifically to an improved container of this type having an additional folding hinge portion which permits the container to be conformed to the shape of related flat stock material while in fully or partially collapsed condition, for convenient shipping and transport purposes.

Collapsible containers of the type having four side-wall sections joined by four integrally formed side-wall hinges arranged in parallel spaced-apart relationship, are well known in the art. Such containers are usually formed of carton-stock such as cardboard, which may be readily joined to itself by gluing for example, and which may be readily imprinted with desired advertising, identifying or ornamental indicia or a combination thereof. End wall sections which are coupled to the edges of the side wall sections by transversely positioned end wall hinges may be provided to form top and/or bottom closures for such containers in a well-known manner.

In the most usual and convenient form of such containers, the cross-section taken in a plane generally perpendicular to the length of the side-wall hinges is that of a parallelepiped; that is: a four-sided figure having two pairs of equal and opposite sides joined at four separate vertices. The sides are usually positioned so that the interior angles formed by the vertices may be varied between 0 degrees and 180 degrees (i.e. a straight angle). In accordance with known trigonometric relationships, the sum total of the four interior angles in such a figure remains equal to 360 degrees, regardless of the relative positions of the two pairs of sides, while the diagonally opposite interior angles remain equal to each other.

It is known that when a container having four sides, as described above, is in its "open" or "assembled" position, the cross-section taken in a plane perpendicular to the length of the side-wall hinges is a rectangle (or a square), in which the interior angle defined by the interior surfaces of the two adjacent side-walls on each side of each hinge, is 90 degrees. It is equally apparent that when such a container is in its "flat" or "collapsed" condition, two of the diagonally opposite interior angles are reduced to 0 degrees, while the two remaining interior angles define substantially straight angles of 180 degrees. These are general characteristics of most four sided collapsible containers, readily known and understood by those having skill in this art.

When such four sided containers are in the collapsed state, the overall maximum width of the flat package is greater than the maximum width dimension of the open or assembled package. Specifically, when the container is flattened or collapsed, it is apparent that the maximum width dimension is equal to the sum of the widths of the two adjacent sides which lie on each side of each straight interior angle.

In some fields, such as in the packaging and mailing of industrial catalogs, and pages and insert sheets therefor, it is common to provide collapsible containers of the type described herein, for convenient collection and storage of groups of single and/or multi-page catalog publications. Often, such containers are provided to prospective customers together with bound volume catalogue publications, in anticipation that they will be used to collect and store later-issued supplements and/or correction or update pages, of lesser individual thickness. Although the thickness of the supplements and the bound volumes may differ significantly, the overall width and length dimensions of each sheet included in the bound volumes as well as in the individual supplements is usually a standard size such as 8½" by 11", for example.

A collapsible container for such standard sized publications accordingly might be provided with two equal sized and oppositely positioned sidewalls having interior width and height of slightly more that 8½" by 11", integrally coupled to and connected by two other side walls of the same or lesser height and each having a width of 1" for example. In the assembled state, such a container would provide an interior storage space approximately 8½" wide and 11" high and 1" thick. In the collapsed state, the overall width of such a container would be substantially 9½", for the reasons explained above.

Because the width of the collapsed container is greater than the width of the papers or similar sized books or pamphlets with which it is to be shipped, packaging and wrapping the combination of different sized elements is inconvenient and can be expensive.

Accordingly, it is an object of this invention to provide a collapsible container which is also conformable to the size of the pages or books which it is intended to contain when it is assembled.

It is a further object of this invention to provide a collapsible and conformable container which can be formed inexpensively using existing container-forming technology.

It is still another object of this invention to provide a collapsible and conformable container which is capable of being collapsed and conformed, and then opened and assembled easily, and without adverse effect on its structural integrity or its usability, in either the collapsed or assembled condition.

A feature of this invention which contributes to accomplishment of the objects set forth above, is the inclusion in a collapsible container, of an auxiliary hinge which aligns with one of the sidewall hinges when the container is in the collapsed state, and which may be pivoted to form an exterior angle less than 180 degrees.

These and other and further objects, features and advantages of this invention will be clearly described and more specifically pointed out in the following specification together with the accompanying drawings, in which.

Figure 1:
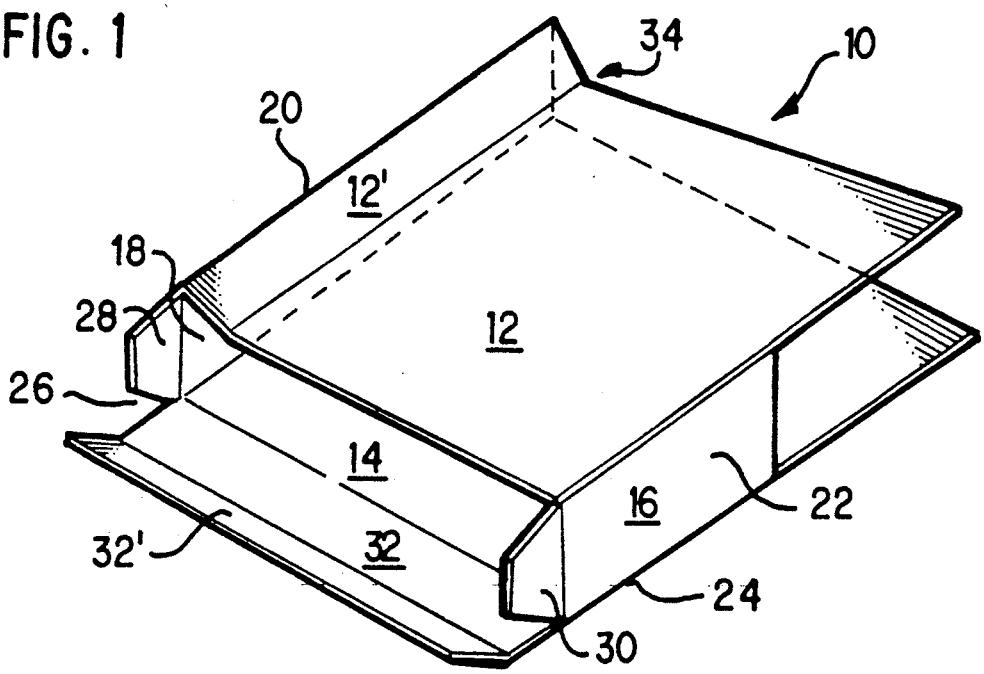
FIG. 1 is a pictorial representation of a collapsible container in accordance with this invention, shown in partially assembled condition.

Referring now more specifically to the drawings, the illustrated embodiment of this invention may be seen to comprise a box designated generally by reference numeral 10, having four side wall portions 12, 14, 16 and 18, which are connected together by four integrally formed hinge portions 20, 22, 24 and 26. The four side walls define two pairs, each pair having two walls of substantially equal size positioned in parallel spaced apart relationship; in the illustrated embodiment, wall sections 12 and 14 form one pair, and wall section 16 and 18 form the second pair. Hinges 20–26 are formed at the intersections between one wall of one pair and the adjacent wall of the second pair; for example, hinge 20 is formed at the intersection between wall 18 of pair 16, 18, and wall 12 of pair 12, 14.

In addition to the four side wall portions thus far described, box 10 may be seen to further include a pair of end wall flaps 28, 30, and a closure flap 32 having a locking flap 32' integrally coupled to a free edge thereof.

When the box 10 is in the "open" or assembled condition shown in FIG. 1, the side walls 12, 14 are spaced at their maximum distance from each other , in parallel relationship, and the interior angle formed by the inner surfaces of walls 12, 14, 16 and 18 which are adjacent to each other on either side of each of hinges 20, 22, 24 and 26, is substantially 90 degrees at each hinge. In this position, the end flaps 28, 30 may be bent inwardly in a known manner at substantially right angles to their associated side walls 18, 16, and the closure flap 32 may be bent inwardly at a right angle to side wall 14 until locking flap 32' may be bent at a right angle to closure flap 32, and inserted into the interior of the box 10, in parallel abutting side-by-side relationship with the inner surface of side wall 12, to form a substantially rigid, assembled box closure of known design.

It is contemplated that the collapsible and conformable container of this invention may be constructed readily of any known suitable material such as cardboard carton stock. Similarly, the hinges 20, 22, 24 and 26 may be formed integrally in the material of the side walls by any suitable known process which results in hinges capable of displacement through interior angles within the range of 0 degrees to 180 degrees; such hinges, formed by known methods, tend to resist displacement through interior angles greater than 180 degrees. It will be understood by persons of skill in this art, that in a collapsible carton of the type herein disclosed, each hinge of one pair of diagonally opposed hinges such as 20, 24, will form an interior angle of 0 degrees when the container is in the "closed" or collapsed position shown in FIG. 2; and correspondingly, the other pair of diagonally opposed hinges will form interior angles of substantially 180 degrees in this position.

Figure 2:
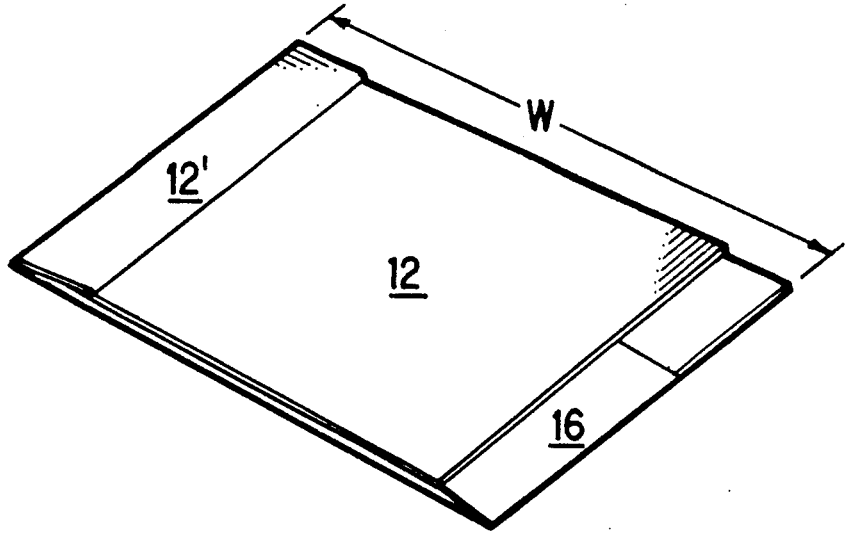
FIG. 2 is a partial pictorial view of the container of FIG. 1, shown in fully collapsed condition, with certain of the end flaps removed for clarity and simplification.

When the container is in the collapsed condition shown in FIG. 2, it forms a substantially flat sheet having a minimum thickness not substantially greater than the thickness of two layers of the carton stock, or other material, which forms the side walls; the maximum width "w" of the collapsed flat sheet is seen to be equal to the combined widths of the two adjacent side walls 12, 16, which is equal to the combined width of side walls 14, 18.

Figure 3:
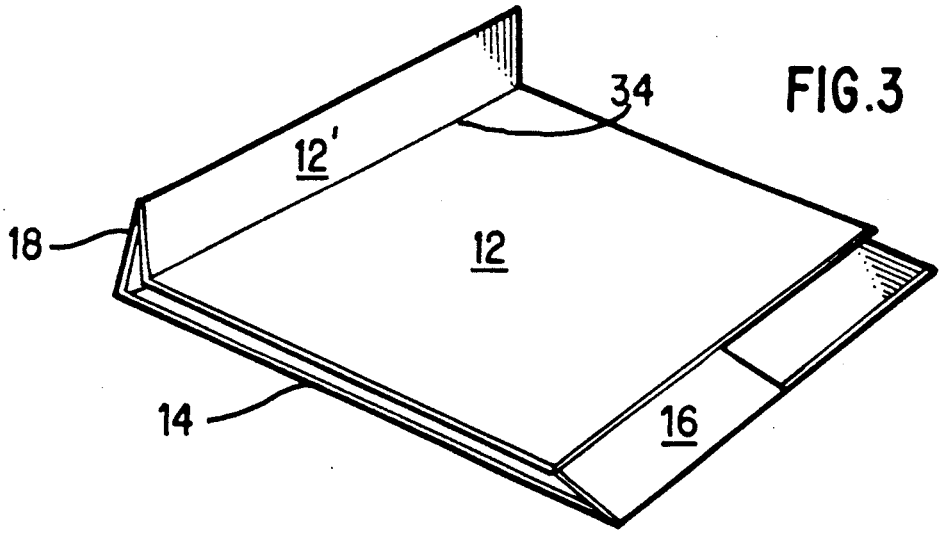
FIG. 3 is a partial pictorial representation of the container of FIG. 2 shown in fully collapsed and conformed condition in accordance with this invention.

In accordance with this invention, one of the side walls 12 is provided with an auxiliary integrally formed hinge 34 which is positioned to lie in parallel, abutting alignment with hinge 26 when the container 10 is collapsed as shown in FIG. 2. In contrast to the four hinges 20, 22, 24 and 26, auxiliary hinge 34 is configured so that the inner surfaces of wall portion 12 and adjacent wall sub-portion 12' on either side of the hinge can be displaced to form interior angles within the range of not less than 180 degrees to approximately 360 degrees. That is: hinge 34 is positioned and configured to "nest" with abutting hinge 26, and to bend in a reverse direction relative to the other hinges, so that adjacent side walls 14, 18 on either side of hinge 26, and adjacent side wall portion 12 and sub portion 12' on either side of hinge 34 can be displaced simultaneously from the position shown in FIG. 2 to the conformed position shown in FIG. 3. It can be seen clearly that when the wall portions are displaced in this manner, the exterior angle defined by the adjacent exterior wall surfaces on either side of hinge 34 will be substantially equal to the interior angle formed by the interior wall surfaces on either side of hinge 26.

In view of the preceding description, it may now be understood that the inclusion of the auxiliary hinge 34, which is capable of being displaced from a straight exterior angle of 180 degrees to a substantially "right" exterior angle of 90 degrees or even less, provides a collapsible container having the unique capability of being conformable from a flat sheet configuration to a two sided right-angle configuration when in the collapsed state. The positioning and function of the auxiliary hinge 34 is such that the tendency to displace its vertex inwardly into the open container is overcome readily by the operation of closure flap 32, and locking flap 32'.

Although a specific embodiment of this invention has been disclosed, it should be understood that various other and different forms and embodiments are possible within the scope of this disclosure and the following claims.

We claim:

1. A collapsible container comprising: a plurality of side wall sections coupled together by a plurality of integrally formed hinge portions disposed in parallel spaced apart relationship, each hinge portion being positioned at a juncture between two adjacent side wall sections; said plurality of side wall sections together surrounding an interior space which may be varied in shape by varying the interior angles formed by the two adjacent wall sections on each side of each hinge portion; one of said hinge portions being specifically constructed to permit displacement to form an interior angle greater than one hundred eighty degrees; and the remaining ones of said hinge portions being constructed to resist displacement into interior angles greater than one hundred eighty degrees; said one of said hinge portions and a selected second one of said hinge portions being equally spaced on opposite sides of a selected third one of said hinge portions such that when the interior angle of said selected third hinge portion is reduced to substantially zero degrees, said one hinge portion and said selected second hinge portion will lie in substantially abutting, parallel relationship, and said one hinge portion may be displaced simultaneously with said second hinge portion to form an exterior angle at said one hinge which is substantially equal to the interior angle at said second hinge portion.

2. A collapsible and conformable container in accordance with claim 1, further including an end flap member integrally hinged to at least one of said side wall members along an edge thereof at an angle to said parallel spaced apart edges thereof.

3. A collapsible and conformable container formed of substantially stiff, flat stock, comprising:

four side wall members coupled together by four integral hinge portions formed along the parallel spaced-apart edges of said side wall members to define an enclosure having a cross section in the shape of a parallelepiped;

said container being collapsible into a generally flattened condition in which two of said hinge portions define interior angles of substantially zero degrees and the remaining two hinges define substantially straight angles of one hundred-eighty degrees, and said parallelepiped shape is reduced to a substantially straight line;

a reverse hinge portion formed in one of said side wall members intermediate the parallel, spaced-apart edges thereof and in parallel relation therewith;

said reverse hinge being positioned to lie in parallel abutting alignment with one of said integral hinges when said container is collapsed into generally flattened condition;

said reverse hinge and the said aligned one of said integral hinges being bendable concurrently when said container is in said generally flattened condition, such that the substantially straight line shape of said parallelepiped may be formed into a right angle.

4. A collapsible and conformable container in accordance with claim 3, further including an end flap member integrally hinged to at least one of said side wall members along an edge thereof at an angle to said parallel spaced apart edges thereof.

* * * * *